United States Patent [19]

Muranaka et al.

[11] 4,441,543

[45] Apr. 10, 1984

[54] METHOD OF ENLARGING WIDTH OF CONTINUOUSLY CAST STRAND

[75] Inventors: Yutaka Muranaka, Tokuyama; Haruji Sadahiro, Shinnanyo, both of Japan

[73] Assignee: Nisshin Steel Co., Ltd., Japan

[21] Appl. No.: 269,565

[22] Filed: Jun. 2, 1981

[30] Foreign Application Priority Data

Jun. 10, 1980 [JP] Japan ..... 55-77111

[51] Int. Cl.[3] ..... B22D 11/08

[52] U.S. Cl. ..... 164/491; 164/459

[58] Field of Search ..... 164/491, 436, 483, 459, 164/418, 461

[56] References Cited

U.S. PATENT DOCUMENTS

| | | | |
|---|---|---|---|
| 3,789,911 | 2/1974 | Bachner | 164/418 X |
| 4,086,951 | 5/1978 | Takahasi et al. | 164/436 X |
| 4,250,945 | 2/1981 | Koshikawa et al. | 164/461 |

FOREIGN PATENT DOCUMENTS

| | | | |
|---|---|---|---|
| 33311 | 8/1981 | European Pat. Off. | 164/491 |
| 2802039 | 8/1978 | Fed. Rep. of Germany | 164/459 |
| 2934983 | 3/1980 | Fed. Rep. of Germany . | |
| 54-114434 | 9/1979 | Japan | 164/459 |
| 54-128939 | 10/1979 | Japan | 164/439 |
| 55-33871 | 3/1980 | Japan | 164/491 |

*Primary Examiner*—Kuang Y. Lin

*Attorney, Agent, or Firm*—Kane, Dalsimer, Kane, Sullivan and Kurucz

[57] ABSTRACT

A method of enlarging the width of a continuously cast strand comprising partially immersing a metallic joint having an I-shaped transverse cross-section in the tail end of a firstly cast strand which is downwardly moving or stationary in a rectangular mold cavity defined by narrow and wide pairs of mold pieces, hold the joint in position until the tail end of the strand is solidified, outwardly moving the narrow mold pieces to define the desired enlarged width of the strand, filling the so-formed openings between the strand and walls of the mold pieces with a refractory material and then with a metallic cushioning material, restarting the continuous strand casting process.

3 Claims, 15 Drawing Figures

METHOD OF ENLARGING WIDTH OF CONTINUOUSLY CAST STRAND

BACKGROUND OF THE INVENTION

The present invention relates to a method of enlarging the width of a continuously cast strand. More particularly, it relates to a method of restarting a continuous strand casting process for producing a cast strand having a wider width than that of a previously cast strand wherein the top end of the newly cast strand is connected with the tail end of the previously cast strand while the tail end of the previously cast strand is still in the mold.

In prior art processes when the width of a cast strand was to be enlarged in a continuous strand casting process, the casting was stopped; the cast strand was removed from the mold; the mold was set so that a product of the desired wider width could be produced; a starter bar sometimes referred to as a dummy bar was inserted into the bottom opening of the mold; the opening between the mold wall and starter bar was sealed with asbestos; and thereafter the casting process was restarted. Such a procedure was apparently timeconsuming.

Recently various methods and molds have been proposed for enlarging the strand width in a continuous casting process.

Japanese patent application No. 51-55278 (Japanese Patent Laid-open Specification No. 52-138437, published on Nov. 18, 1977) discloses a method of enlarging the width of a continuously cast strand wherein the width of the strand being cast is enlarged by gradually outwardly moving narrow mold pieces 51, which define the width of the cast strand, while continuing the casting process (See FIG. 1). However, this method involves various difficult problems. The rate at which the narrow mold pieces are moved is preferably controlled in accordance with the casting rate, and thus, an additional mechanism for providing such a control was needed. The narrow mold pieces must be moved while keeping the smallest possible openings between walls of the widened mold pieces and the abutting ends of the narrow mold pieces. Consequently, motors of a large capacity were required for driving the movement of narrow mold pieces. By this method it is impossible to significantly enlarge the width of the cast strand quickly. The product strand has a substantial lengthwise portion, in which the width gradually varies and which cannot be further processed in the same manner as conventional strands, leading to a reduction in the yield of usable strand. Furthermore, failure to properly control the rate, at which the narrow mold pieces are moved, with respect to the casting rate as well as any leakage of molten metal through any openings between the abutting faces of the wide and narrow mold pieces, will pose a problem of "break-out" accidents.

According to a method disclosed in Japanese patent application No. 50-65654 (Japanese Patent Laid-open Specification No. 51-141721, published on Dec. 6, 1976), inwardly and outwardly movable rest plates 52 are provided beneath the bottom ends of narrow mold pieces 51 (See FIG. 2). When the width of the strand being cast should be enlarged, the casting is stopped; the rest plates 52 are inwardly moved until the inner ends of the rest plates 52 come in contact with the strand (FIG. 2*a*); the narrow mold pieces are outwardly moved until they define the desired enlarged width; the openings so formed between the strand and the walls of the mold pieces are filled with a metallic cooling materials 53; a molten metal is poured into the mold (FIG. 2*b*); the process is restarted; the rest plates 52 are outwardly moved away; and the casting process is restarted for producing a wider strand. In this method, however, means for inwardly and outwardly moving the rest plates are needed, rendering the installation more complicated. Furthermore, a serious disadvantage is involved in that because of a great difference of the solidified shape between the middle and edge portions of the width of the strand, a "break-out" accident is liable to occur upon drawing the strand from the mold.

Japanese Utility Model Registration Application No. 47-71348 (Japanese Utility Model Laid-open Specification No. 52-16255, published Apr. 12, 1977) discloses a method of enlarging the width of a continuously cast strand using a mold wherein each of the narrow mold pieces is divided into upper and lower pieces 51*a* and 51*b* as shown in FIG. 3. In practice when the tail end of the cast strand has reached the level of the lower ends of the upper narrow mold pieces 51*a*, oscillation of the mold and drawing of the strand from the mold are stopped, and the upper narrow mold pieces 51*a* are outwardly moved to define the desired enlarged width of the strand to be cast therebetween. On the shoulders so formed on the upper ends of the lower narrow mold pieces 51*b* within the mold cavity, cooling boxes 53 filled with a cooling material are placed (FIG. 3*a*). A molten metal is poured into the mold. After the skin of strand, especially that portion contacting with the cooling boxes, has been sufficiently solidified, the lower narrow mold pieces 51*b* are outwardly moved until they define the new width of the strand. The casting process is then restarted (FIG. 3*b*). This method, however, suffers from such disadvantages that the division of each narrow mold piece into two parts renders the structure of mold more complicated; care should be taken so that no gaps will be formed between the upper and lower narrow mold pieces in the course of normal casting; and the extent of enlarging the width is limited by the thickness of the upper and lower narrow mold pieces. Furthermore, any leakage of molten metal through any openings between the abutting ends of the upper and lower narrow mold pieces at the time one of the upper and lower pieces is slidably moved might invite a "break-out" accident.

SUMMARY OF THE INVENTION

An object of the invention is to provide a method of enlarging the width of a continuously cast strand which method does not suffer from the disadvantages of the prior art discussed above, such as complicated mold structure, considerable loss of strand upon enlargement of the width of strand, liability of a "break-out" accident, and limited amount of change in the width of strand.

The present invention is a method of enlarging the width of a continuously cast strand that comprises the steps of partially burying a metallic joint having an I-shaped transverse cross-section in the tail end of a cast strand which is downwardly moving or stationary in a rectangular mold cavity defined by narrow and wide pairs of mold pieces so that the longitudinal axis of said joint is substantially horizontal and in parallel with walls of the wide mold pieces, solidifying the tail end of the strand, outwardly moving the narrow mold pieces to define the desired enlarged width of the strand, filling the so-formed openings between the strand and the walls of the mold pieces with a refractory fibrous material and then with a metallic cushioning material in the form of powder, tape or fiber, and restarting the continuous strand casting process, all the steps being carried out before said tail end of the strand leaves the mold cavity.

DETAILED DESCRIPTION OF THE INVENTION

Figure 1A:
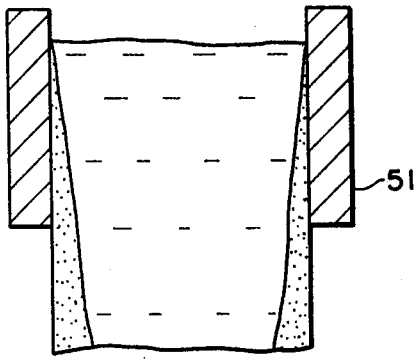
FIGS. 1 through 3 schematically illustrate prior art methods of enlarging the width of a continuously cast strand, of which each figure suffixed by a depicts the state before the width of the strand is enlarged, while each figure suffixed by b depicts the state after the width of the strand is enlarged.
Figure 1B:
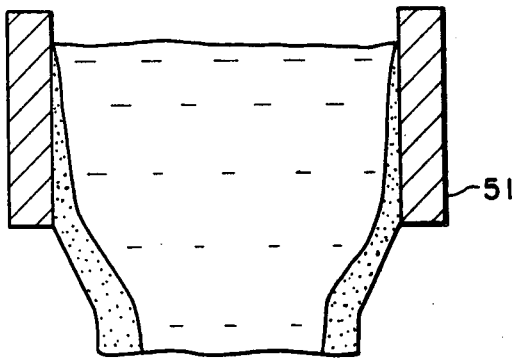
Figure 2A:
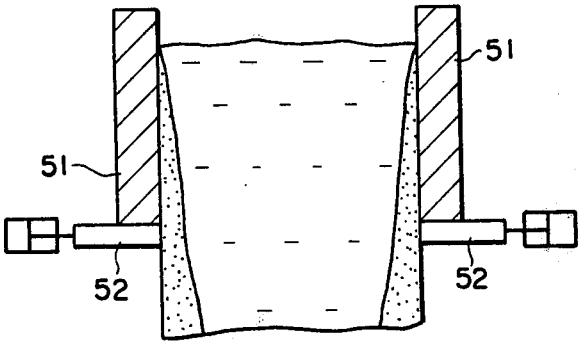
Figure 2B:
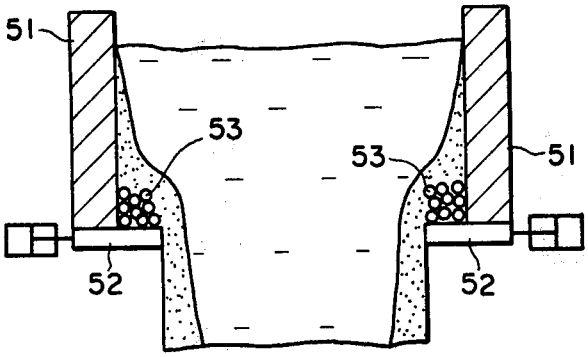
Figure 3A:
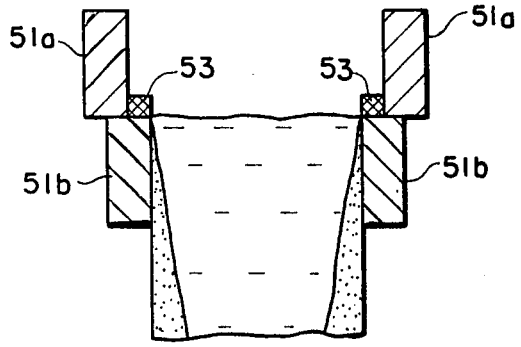
Figure 3B:
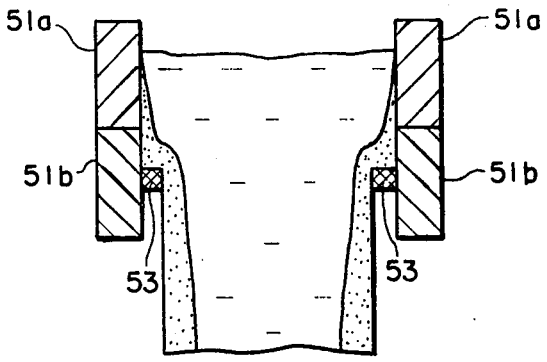
Figure 4:
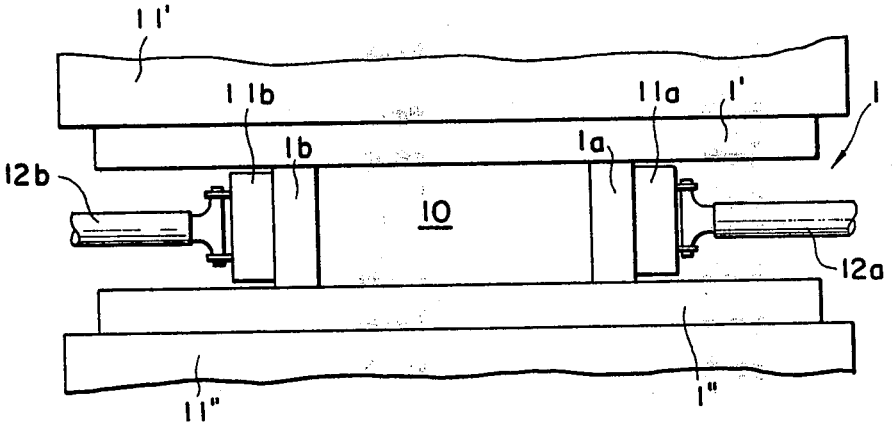
FIG. 4 is a plan view of a mold which may be used in the practice of a method according to the invention.

FIG. 4 illustrates a mold usable in a continuous strand casting process. Such a mold can be used in the practice of a method according to the invention. The illustrated mold 1 comprises a pair of wide mold pieces 1' and 1'', which are vertically arranged in parallel to define the thickness of the cast strand, and a pair of narrow mold pieces 1*a* and 1*b*, which are arranged vertically in parallel and slidably but tightly mounted between the opposing walls of the wide mold pieces 1' and 1'' to define the width of the cast strand. The mold cavity 10 formed by the wide and narrow mold pieces has a rectangular horizontal cross-section. On the back wall of each mold piece 1', 1'', 1*a* or 1*b* is securely mounted its own cooling means 11', 11'', 11*a* or 11*b*. Driving bars 12*a* and 12*b* are respectively fixed to the cooling means 11*a* and 11*b* on their back surfaces. By pushing or pulling the driving bars 12*a* and 12*b* the narrow mold pieces 1*a* and 1*b* can be inwardly or outwardly moved to reduce or enlarge the width of the strand to be cast.

When the width of the strand being cast is to be enlarged the, supply of a molten metal into the mold and oscillation of the mold are stopped. However, drawing of the strand from the mold may be stopped or need not be stopped provided that all the steps of a method in accordance with the invention are carried out before the tail end of the firstly cast strand having a narrower width leaves the mold cavity. FIGS. 5*a*,5*b*,5*c* and 5*d* illustrate different steps of the method of the invention which is carried out without stopping drawing of the strand from the mold. If any slag is present floating on the molten metal in the mold, it should preferably be bailed out from the mold.

Figure 5A:
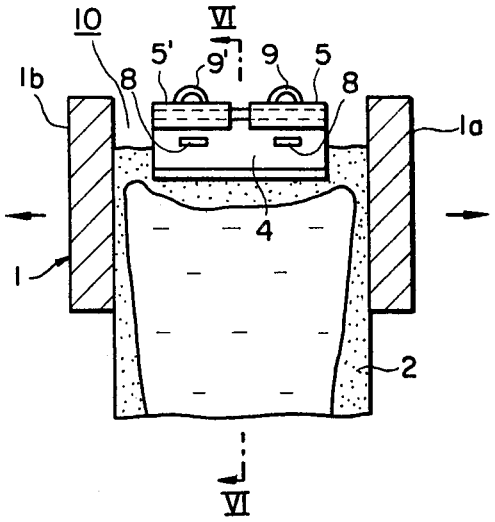
FIGS. 5*a*, 5*b*, 5*c* and 5*d* are schematic vertical cross-sectional front views of the mold and strand in different steps of a method according to the invention.
Figure 5B:
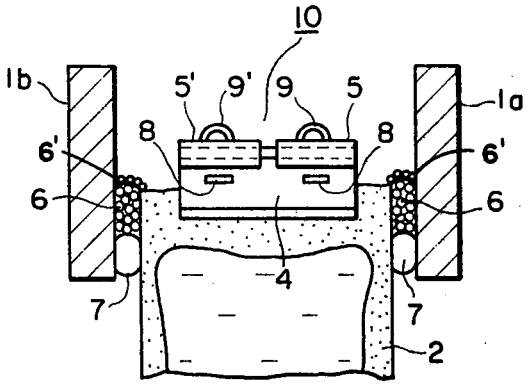
Figure 6:
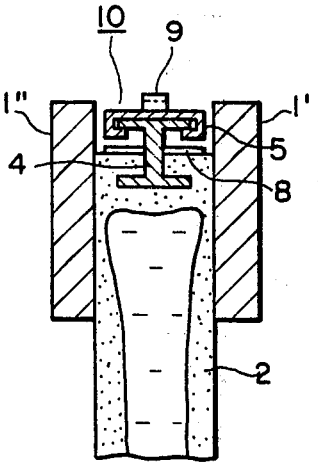
FIG. 6 is a vertical cross-sectional side view of the mold and strand shown in FIG. 5*a*, taken along the line VI—VI.

In a method according to the invention, the present metallic joint having an I-shaped transverse cross-section 4 is partially immersed in the tail end of a cast strand 2 which is downwardly moving or stationary in a rectangular mold cavity 10 defined by narrow and wide pairs of mold pieces 1*a*,1*b*; 1', 1'' so that the longitudinal axis of the joint 4 is substantially horizontal and in parallel with walls of the wide mold pieces 1', 1'', and held in that state until the tail end of the strand is solidified (FIGS. 5*a* and 6).

Figure 7:
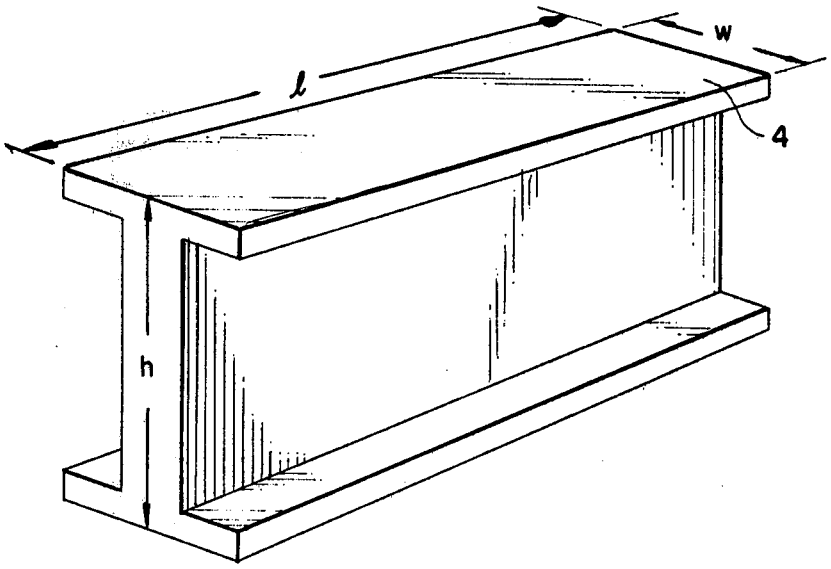
FIG. 7 is a perspective view of a metallic joint which may be used in the practice of a method according to the invention.

The most simple embodiment of the metallic joint having an I-shaped transverse cross-section is shown in FIG. 7. Preferably, the material of the joint is the same as or similar to that of the firstly or secondly cast strand. Thus, in the continuous strand casting of steel or stainless steel slab, rail or H-shaped steel for a construction purpose which has been cut to an appropriate length may be conveniently used as the metallic joint in the method of the invention. For example, in the continuous strand casting of copper, a copper joint should preferably be used. Preferably, with reference to FIG. 7, the length of the joint l is not more than 10 cm smaller than the width of the strand and the width of the joint w is not more than 4 cm less than the thickness of the strand. The height of the joint h may be such that it ensures a satisfactory joint strength. In the casting of slab the height h of the joint may be from about 15 cm to about 30 cm. In order to facilitate handling of the joint 4, it may be provided on its top face with inverted U-shaped members which can be easily hooked (not shown in FIG. 7). It may also be provided approximately in the middle of its height with transversely extending plates or bars (not shown in FIG. 7). Such plates or bars provide not only a certain resistance against the tendency for the joint 4 to wholely sink in the tail end of the strand, but also a measure indicating that the joint should be held in the tail of the strand so that only the portion below the transversely extending plates or bars is immersed until the tail end of the strand is solidified.

Figure 8A:
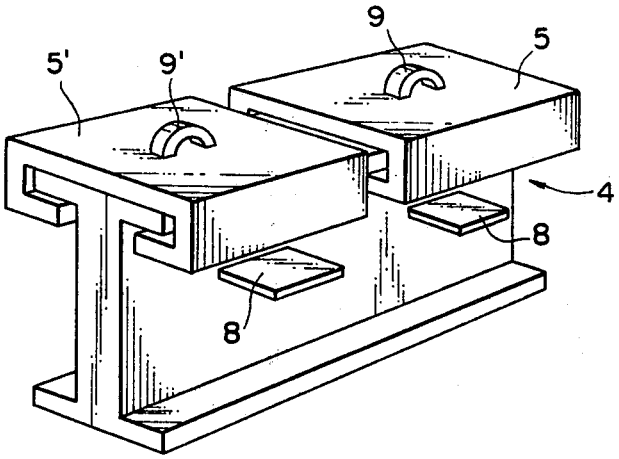
FIGS. 8*a* and 8*b* are perspective views of a preferred metallic joint which may be used in the practice of the invention, depicting different states of the joint.
Figure 8B:
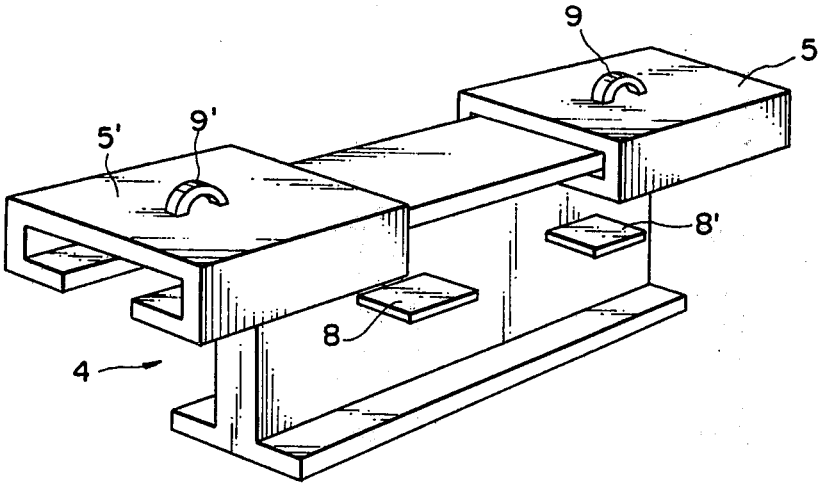

FIGS. 8*a* and 8*b* illustrate a preferred embodiment of the metallic joint having an I-shaped transverse cross-section, showing different states of the joint. The joint 4 shown in FIGS. 8*a* and 8*b* is provided on its top face with two metallic plates 5,5'' slidable along its longitudinal axis, and also approximately in the middle of its height with transversely extending plates or bars 8. On the top face of each slidable plate 5,5', an inverted U-shaped member 9,9' which can be easily hooked is fixed by welding. A screwed eye bolt may be used in place of the welded members 9,9'. FIGS. 5*a*,5*b*,5*c*,5*d* and 6 illustrate the method of the invention wherein a preferred metallic joint as shown in FIGS. 8*a* and 8*b* is used.

Figure 5C:
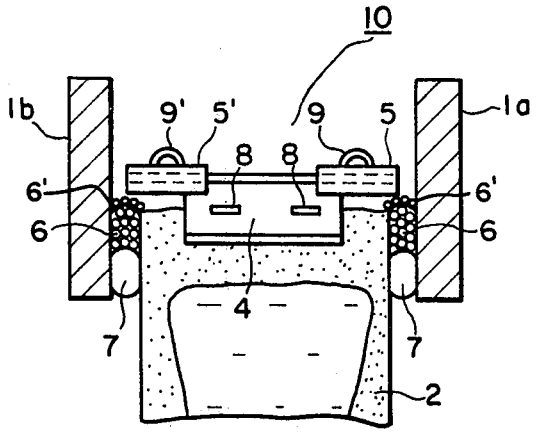

As shown in FIG. 5*a*, the joint 4 is held in the tail end of the firstly cast strand 2 so that only the portion of the joint below the plates or bars 8 is immersed until the tail end of the strand is solidified. After the solidification of the tail end of the strand 2, the narrow mold pieces 1*a* and 1*b* are outwardly moved by pulling the driving bars 12*a* and 12*b* (FIG. 4) to define the desired enlarged width for a strand to be secondly cast, and the so-formed opening between the strand 2 and the walls of the mold pieces is filled with a refractory material 7 such as asbestos and then with a metallic cushioning material 6 in the form of powder, tape or fiber (FIG. 6*b*). Lathe wastes may be conveniently used as the cushionic tape. The metallic cushioning material 6 serves to seal the openings between the strand 2 and walls of the narrow mold pieces 1*a*,1*b* on the one hand, and to cool and coagulate a stream of the secondly cast molten metal coming into the openings on the other hand. The refractory material 7 serves to seal the openings and prevents any secondly cast molten metal that has passed through the cushioning material from leaking out. When the width of the strand is enlarged to a relatively large extent, for example 25 mm or more on one side, using a joint as shown in FIG. 7 it is preferred to place an additional metallic cooling material 6' such as metallic rods, pipes or other pieces on the metallic cushioning material 6 filled in the openings in order to ensure an even cooling of the top end of the strand to be cast secondly. However, when a preferred joint as shown in FIGS. 8*a* and 8*b* is used, the additional metallic cooling material need not be used. We have found that a satisfactory even cooling of the top end of the secondly cast strand can be achieved even if the required increase of the width amounts up to 10 cm or more, by using the preferred joint and simply by sliding the plates 5,5' towards the walls of the narrow mold pieces 1*a*,1*b* so that the plates partially extend beyond the longitudinal ends of the joint 4 before the casting process is restarted (FIGS. 5*c* and 8*b*). The plates 5,5' act as an additional cooling material to ensure an even cooling of the top end of the secondly cast strand but also as a shock absorber to protect the metallic cushioning material 7 from being directly struck by the secondary cast molten metal.

Figure 5D:
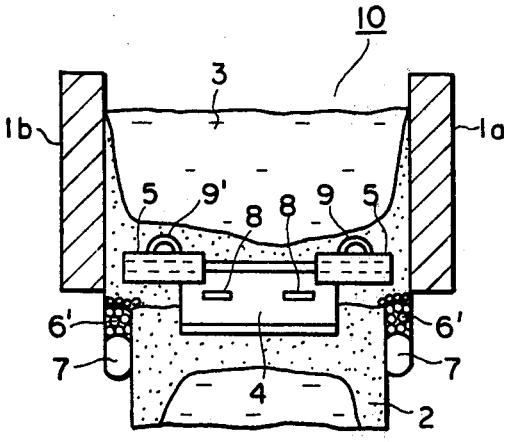

The continuous casting of the second metal is then started and the oscillation of the mold is restarted (FIG. 5*d*). In any event care should be taken so that the top end of the secondly cast strand 3 should be drawn from the mold after it has been solidified.

The joint 4 serves to firmly connect the tail end of the firstly cast strand 2 with the top end of the secondly cast strand 3, and also acts as a cooling material for cooling the molten metal forming the top end of the secondly cast strand. Consequently, leakage of molten metal due to uneven cooling and insufficient strength of of the unitary product at the point where the strands 2 and 3 are joined together is avoided.

The chemical composition of the secondly cast strand may be the same as or slightly different from that of the firstly cast strand.

While the method of the invention is useful for enlarging the width of strand in continuous strand casting of steel or stainless steel, it will be also useful for enlarging the width of strand in continuous strand casting of other metals, such as copper.

What is claimed is:

1. A method of enlarging the width of a continuously cast strand comprising the steps of partially burying a metallic joint having an I-shaped transverse cross-section in the tail end of a cast strand which is in a rectangular mold cavity defined by narrow and wide pairs of mold pieces so that the longitudinal axis of said joint is substantially horizontal and in parallel with walls of the side mold pieces, solidifying the tail end of the strand, outwardly moving the narrow mold pieces to define the desired enlarged width of the strand, filling the so-formed openings between the strand and the walls of the mold pieces with a refractory fibrous material and then with a metallic cushioning material in the form of power, tape, or fiber; restarting the continuous strand casting process, all the steps being carried out before said tail end of the strand leaves the mold cavity; and said metallic joint is provided on its top face with two metallic plates slidable along its longitudinal axis and wherein said plates are slidably moved on the top face of said joint towards the walls of the narrow mold pieces so that said plates partially extend beyond the longitudinal ends of said joint before the casting process is restarted.

2. The method in accordance with claim 1, wherein metallic pieces are placed on said metallic cushioning material filling said opening, before the casting process is restarted.

3. A method in accordance with any one of the preceding claims wherein said metallic joint is provided approximately in the middle of its height with transversely extending plates or bars and wherein the portion of said joint below said transversely extending plates or bars is buried in the tail end of the cast strand.

* * * * *

UNITED STATES PATENT AND TRADEMARK OFFICE

CERTIFICATE OF CORRECTION

PATENT NO. : 4,441,543

DATED : April 10, 1984

INVENTOR(S) : Yutaka Muranaka et al.

It is certified that error appears in the above-identified patent and that said Letters Patent is hereby corrected as shown below:

Column 4, line 41, "5'" should read -- 5' --.

Signed and Sealed this

Fourth Day of June 1985

[SEAL]

*Attest:*

DONALD J. QUIGG

*Attesting Officer* *Acting Commissioner of Patents and Trademarks*